United States Patent [19]

Nally et al.

[11] 4,406,553

[45] Sep. 27, 1983

[54] DISPOSABLE, SNAP-IN-TYPE RIBBON CASSETTE HAVING A RESILIENT RIBBON SPOOL MOUNTING ARM

[75] Inventors: Rickard P. Nally; Elbert H. Vandenham, both of Waterloo, Canada

[73] Assignee: NCR Corporation, Dayton, Ohio

[21] Appl. No.: 333,147

[22] Filed: Dec. 21, 1981

[51] Int. Cl.[3] ..... B41J 33/14

[52] U.S. Cl. ..... 400/208; 400/234; 400/242; 400/248; 400/249

[58] Field of Search ..... 400/194, 195, 196, 196.1, 400/207, 208, 208.1, 229, 234, 242, 243, 248, 249; 242/55, 19 A, 75.4, 75.52, 194, 197, 198, 199, 200

[56] References Cited

U.S. PATENT DOCUMENTS

| | | | |
|---|---|---|---|
| 1,933,562 | 11/1933 | Michel | 242/199 |
| 2,810,574 | 10/1957 | Daniel | 242/55.19 A |
| 3,718,301 | 2/1973 | Morton | 242/197 X |
| 3,822,835 | 7/1974 | Shore | 242/55.19 A |
| 3,921,935 | 11/1975 | Springsits | 242/194 |
| 3,995,731 | 12/1976 | Miller et al. | 400/195 |
| 4,091,913 | 5/1978 | Ku et al. | 400/229 X |
| 4,279,390 | 7/1981 | Wo et al. | 242/194 X |

*Primary Examiner*—Ernest T. Wright, Jr.

*Attorney, Agent, or Firm*—J. T. Cavender; Albert L. Sessler, Jr.; Elmer Wargo

[57] ABSTRACT

A cassette for storing a ribbon having a top portion and a bottom portion. The top portion has a front area having a print station area thereat and a rear area, and also has a first resilient arm having one end extending from the front area to the rear area and also having a free end. A ribbon supply reel is rotatably supported on the first arm and the top portion also has a second resilient arm formed therewith having a free end which engages the rim of the supply reel to form a drag thereon. The ribbon from the supply reel passes around the free end of the first arm, around a ribbon usage sensor, to the print station and is withdrawn back into the cassette by a take up reel located underneath the supply reel, with the take-up reel driven by a spindle.

11 Claims, 8 Drawing Figures

DISPOSABLE, SNAP-IN-TYPE RIBBON CASSETTE HAVING A RESILIENT RIBBON SPOOL MOUNTING ARM

BACKGROUND OF THE INVENTION

This invention relates to ribbon cassettes, and more particularly it relates toi a disposable cassette whipch is capable of being snapped into position in association with a print station.

In recent times, there has been a trend towards making ribbon cassettes easier to load into position on a printing mechanism without having the operator handle the ribbon.

Some of these cassettes are expensive to manufacture and have a complex structure.

SUMMARY OF THE INVENTION

The cassette of this invention is simple in construction, generally inexpensive to manufacture, and easy to load in operative association with a printing apparatus, without requiring the ribbon to be touched by the operator installing it. Because it is of low cost, it may be discarded after use.

In a preferred embodiment of this invention, the cassette includes a top portion and a bottom portion, with the top portion comprising: a front area having a print station area thereat and a rear area; a first resilient arm having one end extending from the front area and also having a free end extending towards the rear area. A ribbon supply reel, having a rim, is rotatably secured to the resilient arm between its ends, and the ribbon, in being unwound from the reel, passes around the free end of the first arm. Ribbon guide means are supplied to enable the ribbon to be guided from the free end of the first arm to the print station area. Also included is a take up reel with the bottom portion having means for rotatably mounting the take up reel thereon so as to receive the ribbon from the print station area. The top portion also has a second resilient arm extending therefrom with this arm having a free end to engage the rim of the supply reel to provide a drag thereon. The take up reel has means enabling it to be rotated to thereby unwind the ribbon from the supply reel to provide a fresh supply of ribbon to the print station area.

The stated advantages and others will be more readily understood in connection with the following specification, claims, and drawing.

DETAILED DESCRIPTION OF THE INVENTION

Figure 1:
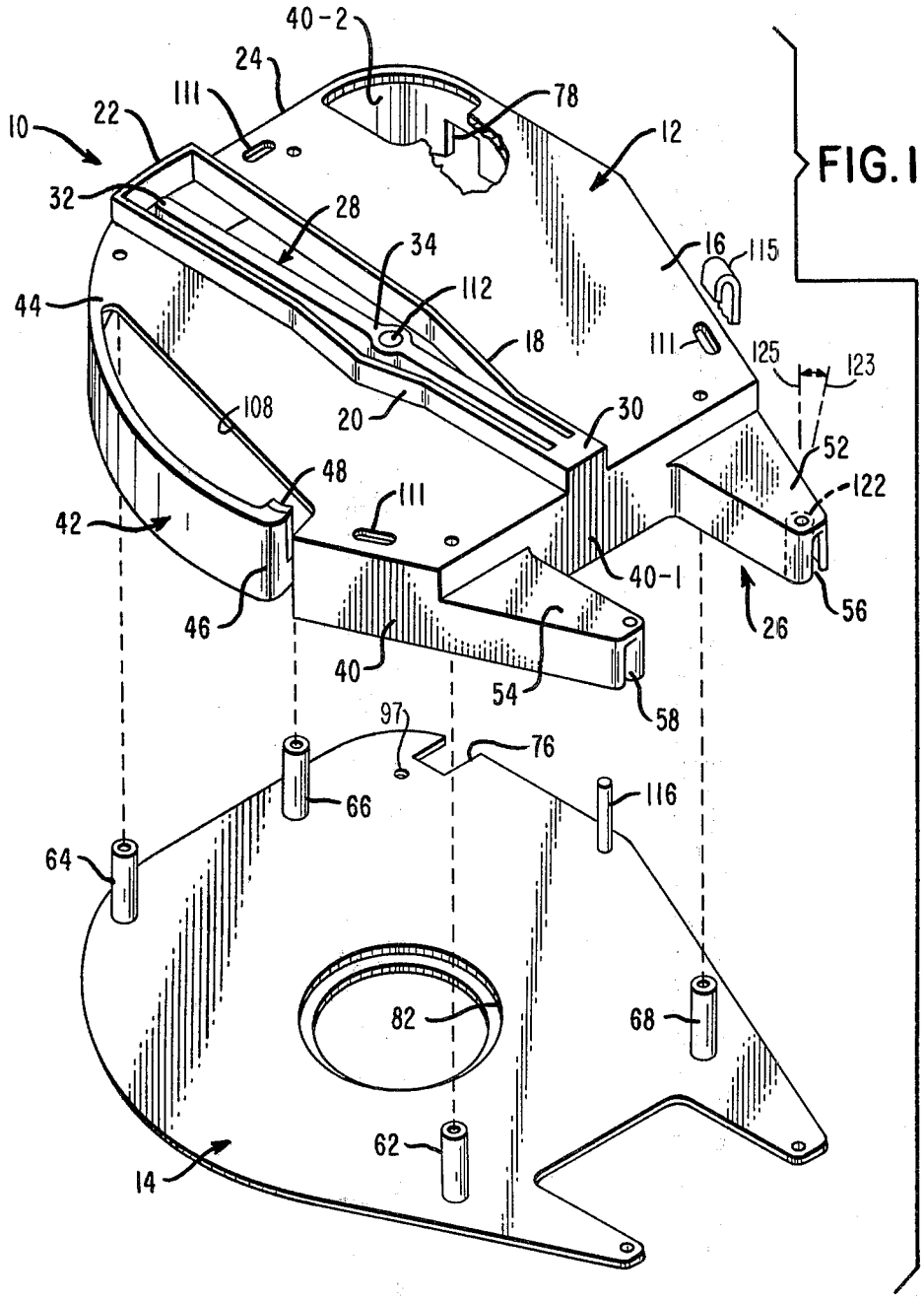
FIG. 1 is an exploded view, in perspective, showing the top portion and bottom portion of the cassette of this invention.

FIG. 1 is a general perspective view of a preferred embodiment of the cassette of this invention which is designated generally as 10 and which is shown in its entirety in FIGS. 1–8. The cassette 10 includes a cover or top portion 12 and a bottom portion 14 which are shown in assembled relationship in FIGS. 3 and 4.

The top portion 12 (FIG. 1) has a generally planar upper surface 16 having walls 18 and 20 upstanding therefrom and a connecting wall 22 at what is referred to as the rear 24 of the top portion 12. The opposite end of the top portion 12 is referred to as the front area or the print area 26.

Figure 4:
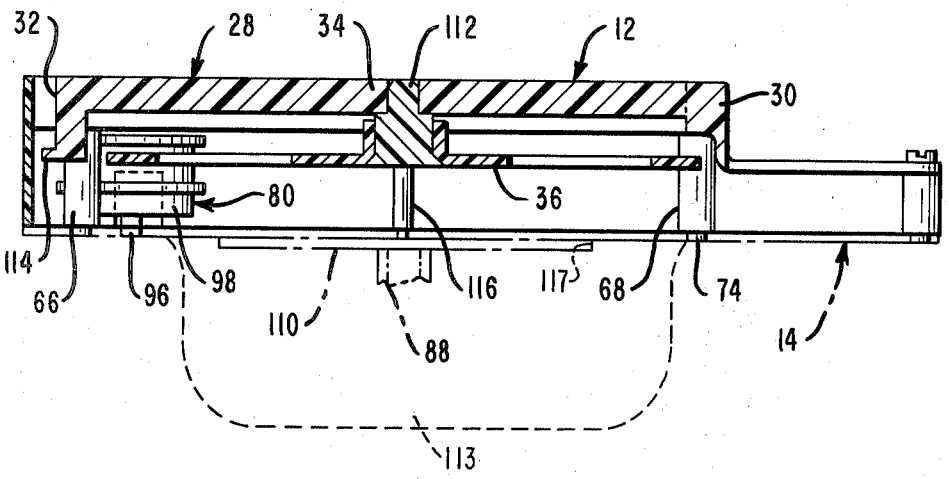
FIG. 4 is a cross sectional view, taken along the line 4—4 of FIG. 2, to show additional details of a first arm of the top portion and the ribbon supply reel attached thereto.

The top portion 12 (FIG. 1) has a first arm 28, being integrally formed with the top portion 12 at area 30, with the free end 32 thereof extending towards the rear 24 of the top portion 12 in cantilever fashion. The first arm 28 has an apertured hub 34 located between its ends, and the hub 34 is used to rotatably support a supply reel 36 as shown in FIG. 4, which supply reel 36 contains a supply of inked ribbon 38 best shown in FIG. 7. The walls 18, 20, and 22 and the area 30 form a protective cavity in which the first arm 28 is located, and also facilitate the forming of arm 28.

Figure 2:
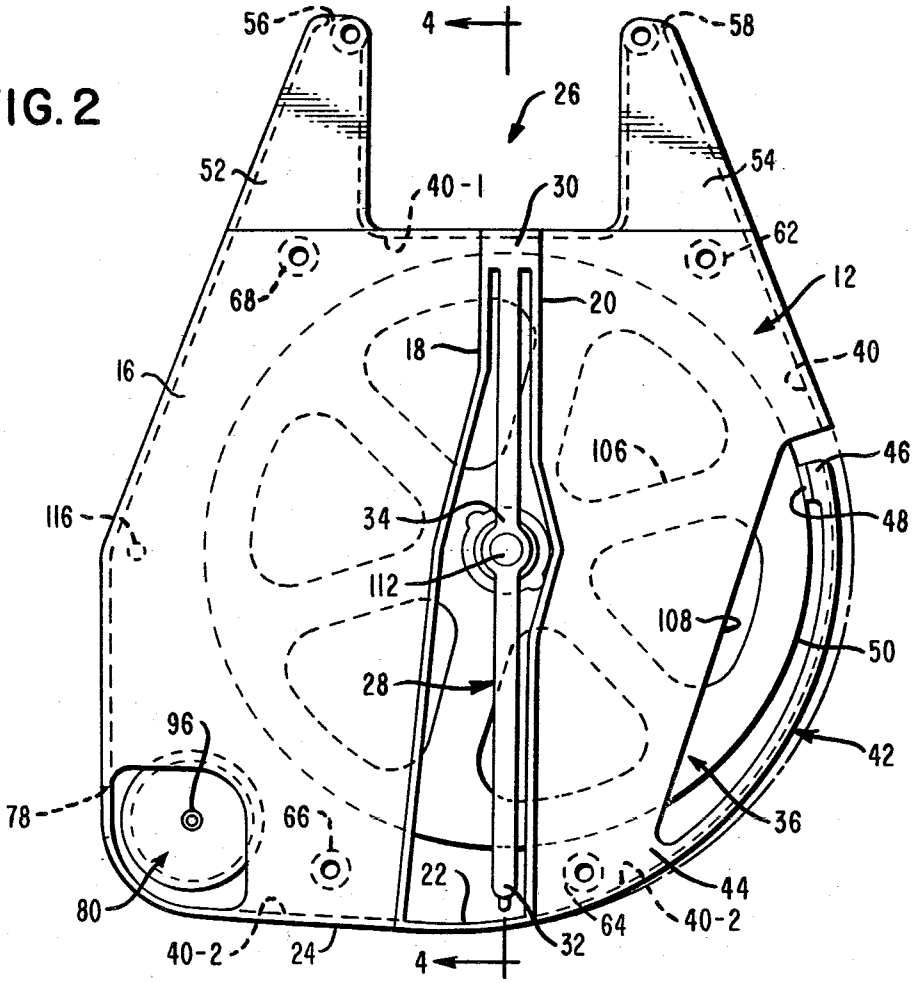
FIG. 2 is a plan view of the cover or the top portion shown in FIG. 1.

The top portion 12 (FIG. 1) also has a skirt depending therefrom and is shown as 40, 40-1, and 40-2. There is a second arm 42 which has one end 44 integrally formed with the skirt 40-2, and the remaining end 46, which is a free end, has a pad 48 secured thereto. When the arm 42 is formed with the top portion 12, it is biased towards the first arm 28 so as to provide a drag on the rim 50 of the supply reel 36 as shown in FIG. 2. This aspect will be described in detail hereinafter.

Figure 7:
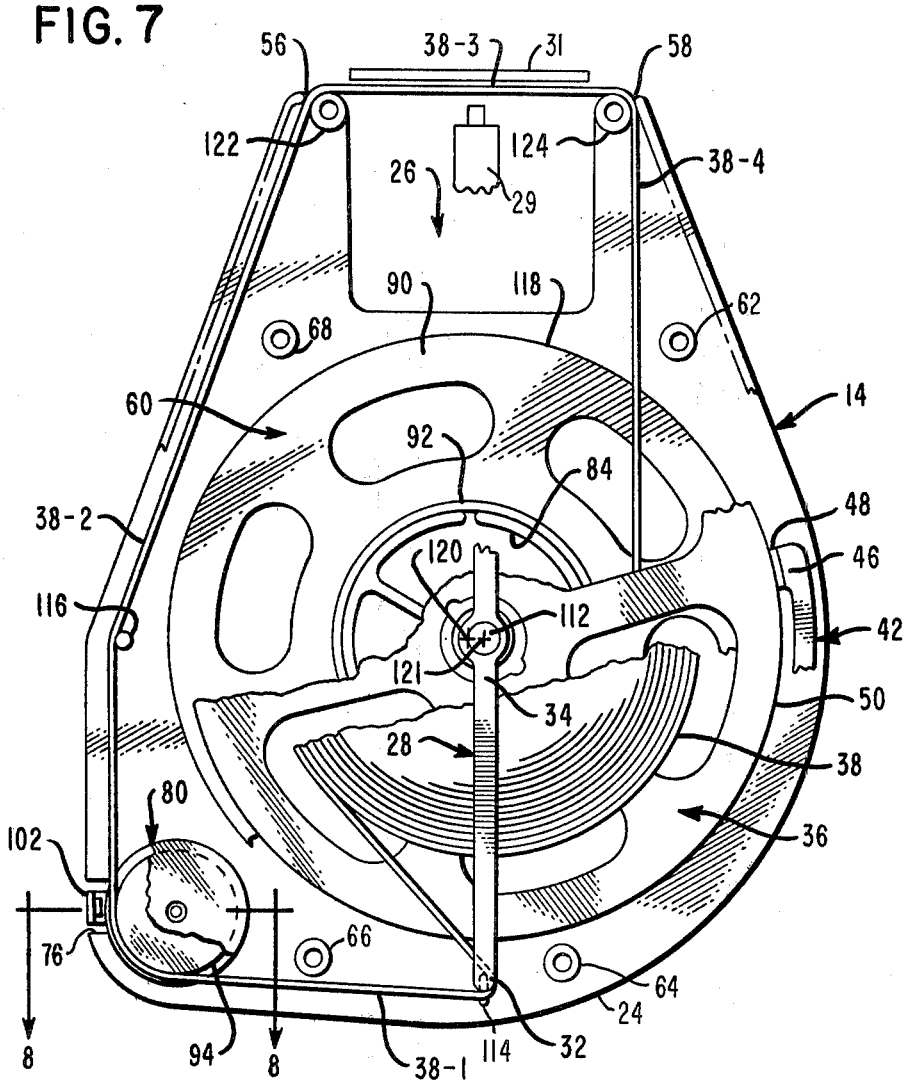
FIG. 7 is a top view of the bottom portion showing the path of the ribbon in travelling from the supply reel, around the free end of the first lever, around a sensor to gauge ribbon usage, around the print station area and to the take-up reel.
Figure 8:
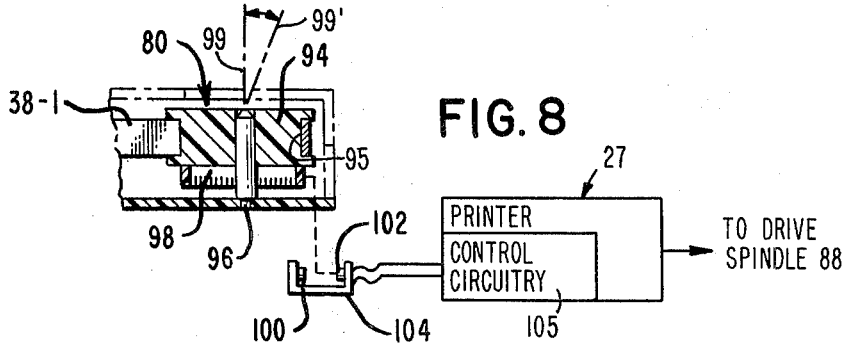
FIG. 8 is a cross-sectional view taken along the line 8—8 of FIG. 7 to show additional details of the sensor shown in FIG. 7.

The top portion 12 also has spaced portions 52 and 54 which extend from the top portion 12, as shown in FIG. 1, to provide the print area 26 and to enable the cassette 10 to be placed in operative relationship with a utilization device such as a printer 27 shown only diagrammatically in FIG. 8. Extending portion 52 has a slot 56 therein through which the ribbon portion 38-3 (FIG. 7) emerges, and similarly, extending portion 54 has a slot 58 therein to enable the ribbon porton 38-4 (FIG. 7) to be returned (after being used) into the cassette 10 to be wound up on the take-up reel 60.

Figure 3:
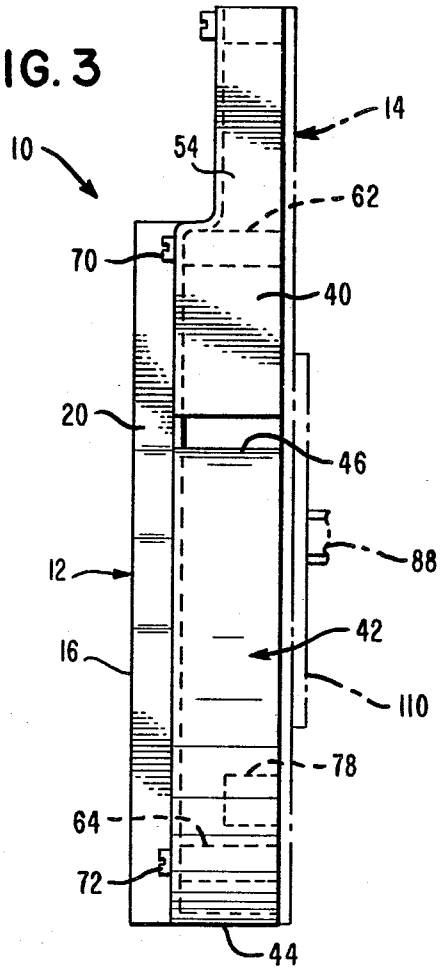
FIG. 3 is a side view of the top portion shown in solid outline and with the bottom portion shown in dashed outline to show the cassette in assembled relationship.

The top portion 12 also has a plurality of posts like 62, 64, 66, 68 (FIG. 1) depending therefrom so as to provide a means for securing the top portion 12 and the bottom portion 14 together. These posts 62, 64, 66, and 68 just mentioned are shown as upstanding from the bottom portion 14 in FIG. 1 to facilitate a showing thereof. These posts like 62 and 64, for example, may be secured to the top portion 12 by fasteners 70 and 72 as shown in FIG. 3, and these posts 62, 64, 66 and 68 have short pins like 74 on post 68 (FIG. 4) which are press fitted into a mating hole 69 (with post 68 being removed in FIG. 5) located in the bottom portion 14 to enable the top portion 12 and the bottom portion 14 to be secured together as is conventionally done. Naturally, while these posts like 68 are described as depending from the top portion 12, they could just as easily be upstanding from the bottom portion 14 if convenient for the manufacture of the cassette 10.

The bottom portion 14 is generally planar in form and is shaped in outline to conform to the outline of the top portion 12 as seen in FIG. 1. The bottom portion has a notch 76 therein which is aligned with a notch 78 in the skirt 40-2 of the top portion 12 to enable a sensor 8 (FIG. 8) to coact with a printer (not shown) as will be described hereinafter. An annular recess 82 (FIG. 1) is provided in the bottom portion 14 to rotatably receive a spool 84 (FIG. 6) which is part of the take-up reel 60. The spool 84 has a hex-shaped, driving hole 86 (FIG. 5) therein which receives a hex-shaped, driving spindle 88 (FIG. 6) which is rotated by the printer (not shown) on which the cassette 10 is mounted. The reel 60 also may include the flange 90 (FIG. 6) joined to a sleeve 92 which is press fitted around the spool 84 to rotate therewith. There is some clearance between the flange 90 and the bottom portion 14 to enable the take-up reel 60 to be rotated freely by the driving spindle 88.

The sensor 80, alluded to earlier herein, is shown in FIGS. 7 and 8. The sensor 80 is conventional and includes a wheel 94 which is rotatably supported on a flanged axle 96 having a shouldered end which is mounted in a suitable hole 97 in the bottom portion 14. The axle 96 has its longitudinal axis 99 tilted about 4 degrees to the right (from the position shown in FIG. 8) to assume the position shown by longitudinal axis 99' to accommodate the ribbon portion 38-1 as it descends from free end 32 of the first arm 28 to the sensor 80. However, the sensor 80 is shown lower in FIG. 4, i.e. closer to bottom portion 14 than it actually is, simply to facilitate a showing of the sensor 80 in FIG. 4. The wheel 94 has an annular recess 95 therein to receive the ribbon portion 38-1 and to enable it to be guided therearound. The wheel 94 has an annular skirt 98 depending therefrom and concentric therewith. The annular skirt 98 is transparent or at least translucent and has a plurality of "lenses" formed therearound. When the assembled cassette 10 is operatively positioned on a printer, for example, the annular skirt 98 is positioned or passed between a source of light 100 and an associated photodetector 102 which are mounted on a "U"-shaped bracket 104 which is located in the printer (not shown). It should be noted that when an unused cassette 10 is placed in operative engagement with a printer, the supply reel 36 is full and the take up reel 60 is empty. In this situation, the driving spindle 88 of the printer must rotate the take-up reel 60 for a longer time period for a given segment of printing than it does when take up reel 60 is getting full. The sensor 80 measures the linear "usage" of the ribbon 38-1 passing therearound via the "lenses" on the skirt 98 (FIG. 8), and conventional control circuitry 105 within the printer 27 interprets the data from the photodetector 102 and thereby controls the rotation of the drive spindle 88 so as to present an appropriate supply of fresh ribbon 38 to the print area 26.

Some additional comments with regard to the various figures mentioned seem appropriate.

FIG. 2 shows the supply reel 36 having certain cut out sections as at 106 to make the cassette 10 lighter and to save on material. The top portion 12 is cut away at area 108 to provide for the molding of the second arm 42.

FIG. 3 shows an offset portion 110 to provide for the recess 82 shown in FIG. 1. The offset portion 110 may be made square in outline to mate with a similarly shaped recess 117 located in the frame 113 (FIG. 4) of the printer 27 on which the cassette 10 may be used to keep it from being rotated while being driven by spindle 88. Suitable recesses like 111 (FIG. 1) may be formed on the top portion 12 to receive detent fingers 115 associated with the frame 113 of the printer 27 to detachably hold the cassette 10 thereon.

FIG. 4 shows a shouldered insert 112 (press-fitted into the hub 34) which is used to rotatably mount the supply reel 36 to the underside (as viewed in FIG. 4) of the first arm 28 to enable the supply eel 36 to rotate freely. The first arm 28 also has a shoulder 114 on the free end 32 thereof so as to retain the ribbon 38 thereon. This end 32 is chamfered so as to enable a smooth flow of ribbon 38 therearound.

Figure 5:
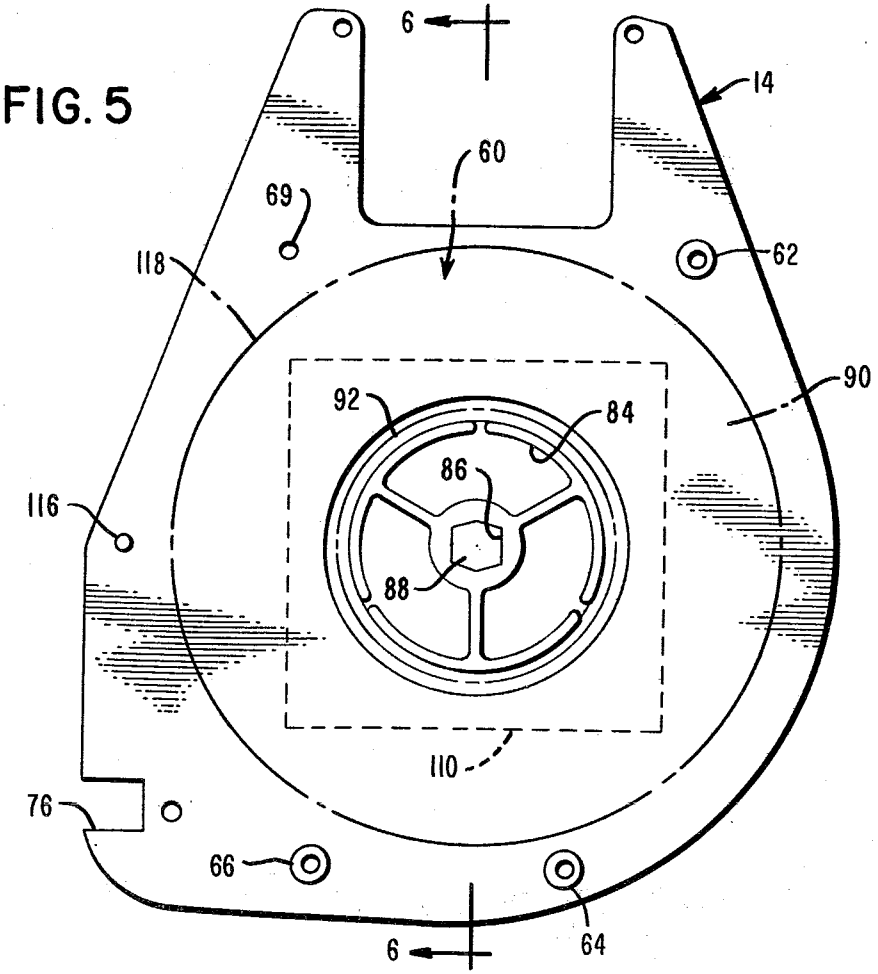
FIG. 5 is a top view of the bottom portion shown in FIG. 1, showing a take-up reel positioned thereon.

FIG. 5 shows the rim 118 of the take-up reel 60 in dashed outline.

Figure 6:
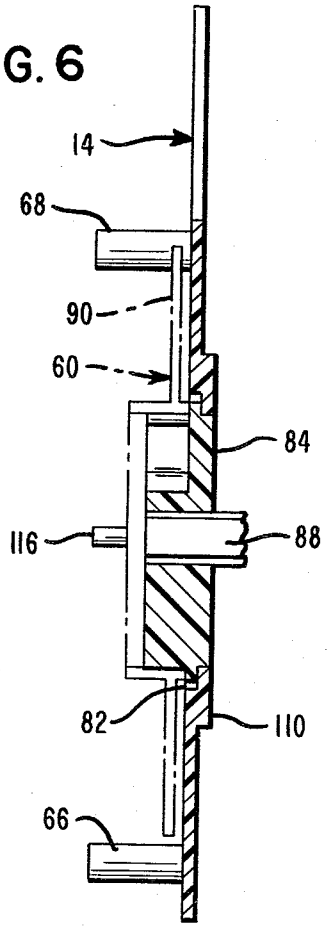
FIG. 6 is a cross sectional view taken along the line 6—6 of FIG. 5.

FIG. 6 shows a guidepost 116 around which the ribbon portion 38-2 travels.

FIG. 7 shows a top view of the bottom portion 14 with the take up reel 60 positioned thereon, and it shows the supply reel 36 positioned therein. Notice that the center 120 for the take-up reel 60 is slightly to the left of the center 121 for the supply reel 36; this enables the pad 48 on the second arm 42 to engage only the rim 50 of the supply reel 36 and not to engage the rim 118 of the take up reel 60.

FIG. 7 shows best the operation of the cassette 10 when it is placed on the spindle 88 of a printer, for example, in operative engagement therewith. The ribbon 38 from the supply reel 36 passes around the end 32 of the first arm 28 as previously explained, and thereafter it passes around the wheel 94 of the sensor 80. From the sensor 80, the ribbon portion 38-2 passes around the guide post 116 and around guide post 122 and through slot 56 where ribbon portion 38-3 emerges from the cassette 10. The portion 38-3 of the ribbon 38 is that portion of the inked ribbon 38 which is in operative engagement with print head 29, a wire matrix for example, associated with the printer 27, to print upon a record medium 31. Thereafter, the used ribbon portion 38-3 is drawn into the cassette 10 through the slot 58 and around guide post 124 to enable ribbon portion 38-4 to be wound up on take up reel 60.

When the driving spindle 88 (FIG. 3) initially starts to rotate the take up reel 60, the free end 32 of the first arm 28 begins to bend to the left as viewed in FIG. 7 (to reduce some of the friction between pad 48 and the rim 50) and thereafter, the supply reel 36 begins to rotate to unwind some ribbon 38 therefrom. This minimizes jerks and excessive stresses on the ribbon 38 while the pad 48 on the second arm 42 always provides some drag on the rim 50 of the supply reel 36 to keep it from overspinning. The ribbon portion 38-2 from wheel 94 is at a higher level than it is when it reaches post 122. To avoid any wrinkling of the ribbon portion 38-3 at post 122, the post 122 is cylindrically shaped and has its longitudinal axis, 23 tilted to the right about 4 degrees (as viewed in FIG. 1 from a line 125 which is perpendicular to the upper planar surface 16 to accommodate the ribbon portion 38-2 (FIG. 7) which converges towards the bottom portion 14 and the ribbon portion 38-3 which moves parallel relative to the bottom portion 14.

In the embodiment described in FIGS. 1–8, the cassette 10 is shown substantially in full size. The cassette 10 is made of a plastic material such as GE Noryl 190 which is manufactured by General Electric Company.

The pad 48 on the second arm 42 is made of felt material, for example, and it contacts the rim 50 of the supply reel 36 during the entire operation of the cassette 10.

We claim:

1. A cassette for storing a ribbon comprising:

a top portion and a bottom portion;

said top portion comprising:

a front area having a print station area thereat and a rear area;

a first resilient arm having one end extending from said front area and also having a free end extending towards said rear area;

a ribbon supply reel having a rim and being rotatably secured to said resilient arm between its ends to enable said ribbon in being unwound from said reel to pass around said free end; and ribbon guide means to enable said ribbon to be guided from said free end to said print station area;

a take up reel;

said bottom portion having means for rotatably mounting said take up reel thereon so as to receive the ribbon from said print station area;

said top portion having a second resilient arm extending therefrom and having a free end to engage the rim of said supply reel to provide a drag thereon;

said take up reel having means enabling said take up reel to be rotated to thereby unwind said ribbon from said supply reel to provide a fresh supply of ribbon to said print station area.

2. The cassette as claimed in claim 1 in which said first and second arms are integrally formed with said top portion.

3. The cassette as claimed in claim 2 in which said top portion has a skirt depending therearound and said second arm forms a portion of said skirt.

4. The cassette as claimed in claim 1 in which a portion of said ribbon guide means is used to secure said top and bottom portions together.

5. The cassette as claimed in claim 4 in which said ribbon guide means includes a sensor located between the free end of said first arm and said print station area for use in determining the linear usage of said ribbon passing thereover.

6. The cassette as claimed in claim 5 in which said ribbon supply reel and said take up reel are positioned in substantially superimposed relationship in said cassette.

7. The cassette as claimed in claim 6 in which said top portion has a wall upstanding therefrom forming a cavity in which said first resilient arm is positioned.

8. The cassette as claimed in claim 6 in which said ribbon guide means includes a cylindrically-shaped post which is located at said print station area and which is tilted a few degrees with respect to a line which is perpendicular to said bottom portion so as to accommodate ribbon slack which results from said ribbon supply reel and said take up reel being in said substantially superimposed relationship.

9. The cassette as claimed in claim 8 in which said sensor has an axis of rotation which is tilted a few degrees with respect to a line which is perpendicular to said bottom portion so as to accommodate ribbon slack which results from said ribbon supply reel and said take up reel being in said substantially superimposed relationship.

10. The cassette as claimed in claim 2 in which said free end of said second resilient arm has a resilient pad thereon to engage said rim of said supply reel.

11. The cassette as claimed in claim 10 in which said cassette includes means enabling said cassette to be detachably secured to a utilization device.

* * * * *